United States Patent [19]

Maraux

[11] 4,042,216

[45] Aug. 16, 1977

[54] CABLE GUIDE

[75] Inventor: Jean Maraux, Saint-Amand-Montrond, France

[73] Assignee: Willy Habegger, Hunibach bei Thun, Switzerland

[21] Appl. No.: 596,251

[22] Filed: July 16, 1975

[30] Foreign Application Priority Data

July 18, 1974 France ..... 74.25011

[51] Int. Cl.[2] ..... B66D 1/36

[52] U.S. Cl. ..... 254/190 R; 254/138

[58] Field of Search ..... 254/190 R, 192, 193, 254/188, 139, 139.1, 138, 137, 175.7, 175.5; 74/230.24, 230.17, 230.11; 226/188

[56] References Cited

U.S. PATENT DOCUMENTS

| | | | |
|---|---|---|---|
| 1,928,117 | 9/1933 | Stewart | 254/138 |
| 2,670,926 | 3/1954 | Sewell et al. | 254/190 R |
| 3,269,704 | 8/1966 | Pfundt | 254/139.1 |
| 3,337,188 | 8/1967 | Manson | 254/192 |
| 3,643,921 | 2/1972 | Puretic | 254/190 R |
| 3,680,758 | 8/1972 | Kinnicutt, Jr. | 254/190 R |
| 3,836,120 | 9/1974 | Niskin | 254/190 R |
| 3,861,651 | 1/1975 | Takamura | 254/175.5 |

FOREIGN PATENT DOCUMENTS

| | | | |
|---|---|---|---|
| 730,748 | 1/1943 | Germany | 254/190 R |

*Primary Examiner*—Robert J. Spar
*Assistant Examiner*—Kenneth Noland
*Attorney, Agent, or Firm*—Karl F. Ross; Herbert Dubno

[57] ABSTRACT

A cable guide comprises a support defining a pair of intersecting pivot axes which are inclined to the horizontal. A pair of wheels are each rotatable on the support about a respective one of the axes and each has an inside face turned toward the inside face of the other wheel and formed by an outer frustoconical region and an inner planar region. These inside faces approach each other most closely at a location above the intersection of the axes and the frustoconical outer regions are parallel to this location. An elastomeric disk is secured to the inner region of each inside face by means of a plate and is of a thickness such that the two elastomeric disks are pressed tightly together at the location at the top of the guide so as to form a groove adapted to receive and guide a cable.

9 Claims, 2 Drawing Figures

CABLE GUIDE

FIELD OF THE INVENTION

The present inventon relates to a cable guide. More particularly this invention relates to a guide for a traction cable such as used for ski lifts, cable cars, and the like.

BACKGROUND OF THE INVENTION

A cable guide is known having a pair of wheels rotatable about respective intersecting axes inclined to the horizontal so that the wheels meet at an upper location above the intersection of the axes and can support the cable at this location. The use of a pair of wheels in this manner gives considerably more strength than is obtained with a single wheel since lateral forces also can be resisted. It is known to provide such an arrangement with wheels carried on a support allowing independent pivoting of one wheel relative to the other so that the wheels can pivot apart and allow a support arm or the like carried on the cable to pass between them. In such an arrangement it is necessary to provide a plurality of such guides in a row, as that guide which has opened up to allow passage of the depending support arm cannot fulfill any supporting function. Such a system also has the disadvantage that it is relatively complicated and quite expensive.

In another known arrangement one of the wheels is formed with an array of radially extending teeth. In this manner the support arm can be received between two of the teeth of this toothed wheel and pass between the wheels without separating them. Such a system has, however, the considerable disadvantage that relatively slow transport speeds must be employed in order to minimize shocks to the system caused by the fitting of the hanger arm into a groove for passage between the wheels. Even when slow transport speeds are employed, however, wear is considerable and the toothed roller must be replaced frequently and the arrangement is very noisy in operation.

Another arrangement is known having two rollers or wheels pivoted in a frame and rotatable but otherwise nondisplaceable relative to each other. These wheels define a gap through which the support arm of the cable car or the like may pass. The disadvantage of such an arrangement is that it does not provide a firm seat for the cable, as the gap between the two wheels can wear and widen to eventually allow the cable to drop through.

OBJECTS OF THE INVENTION

It is therefore an object of the present invention to provide an improved cable guide.

Yet another object is the provision of a cable guide which is simple and inexpensive to manufacture, yet which provides a firm seat for the cable while allowing the support arm hanging therefrom to pass the guide.

Yet another object is the provision of such a cable guide which has renewable wear surfaces and which operates noiselessly.

SUMMARY OF THE INVENTION

These objects are obtained according to the present invention in a cable guide comprising a support defining a pair of intersecting pivot axes inclined to the horizontal. Two wheels are rotatable on the support each about a respective one of the axes and each has an inside face turned towards the inside face of the other wheel. The inside faces approach one another most closely at a location above the intersection of the pivot axes and these faces are spaced apart at this location by a predetermined distance. An elastomeric disk is secured to the inside face of each wheel and has an outer rim of a thickness equal to at least half the predetermined distance between the faces. Thus these disks are pressed together at the location by the wheels and the outer rims form at this location an upwardly open cable-receiving groove. With this system an extremely quiet support is provided with the cable riding on the outer rims of the elastomeric disks that are pressed tightly together so as to form a smooth support groove.

According to another feature of this invention each of the inside faces of each wheel is formed of a frustoconical outer region centered on the respective axis and a planar inner region perpendicular to the respective axis. The disk is generally planar when unstressed and the guide further comprises means for securing these disks to the inner regions. Thus in accordance with the present invention the elastomeric disks are deflected inwardly and pressed together by the frustoconical surfaces at the location above the intersection of the wheel axes.

In accordance with yet another feature of this inventon each of the disks is annular and is secured to the inside region of the respective wheel by means of a plate. Either the wheel or the plate is formed with an axially extending hub so that this plate may securely clamp the disk in place on the wheel. The wheels themselves are formed with inside faces of frustoconical shape that are parallel and spaced apart below the location so as to allow a depending support arm for a cable car or the like supported by the cable to pass between the wheels.

Thus not only is this arrangement extremely silent, but it is possible for the support arm to pass between the wheels at a relatively high speed without any damage to the structure or slowing down of the cable. Such passage between the wheels merely deforms the elastomeric material of the disks in the direction of the cable, in no way damaging these disks.

BRIEF DESCRIPTION OF THE DRAWING

The above and other objects, features, and advantages of the invention will become more readily apparent from the following description, reference being made to the accompanying drawing in which:

FIG. 2 is a section through a detail of another type of disk according to the present invention.

SPECIFIC DESCRIPTION

Figure 1:
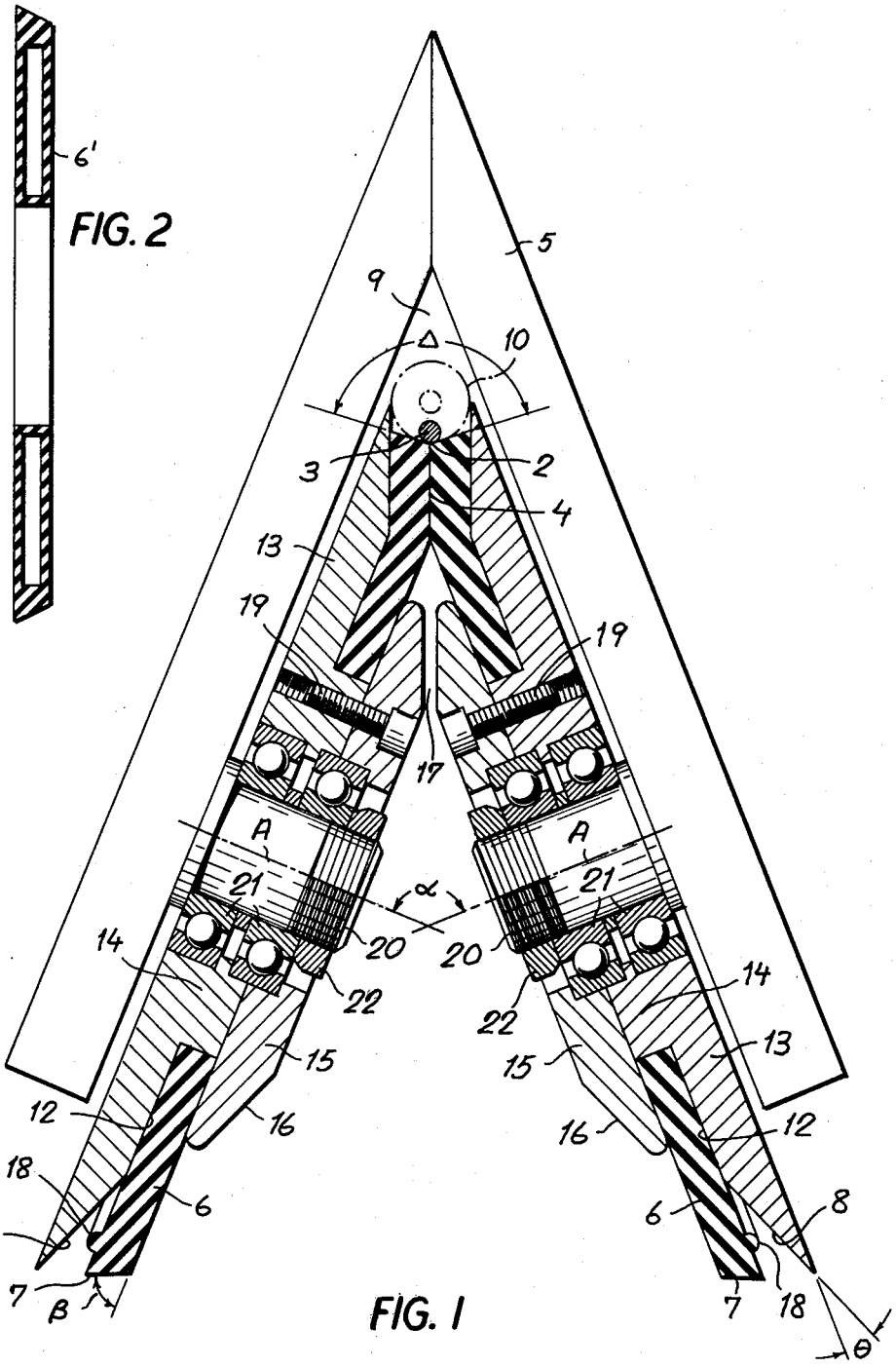
FIG. 1 is a vertical section through the guide according to the present invention.

As shown in FIG. 1 a cable guide comprises a pair of wheels 1 secured to an inverted V-shaped support 5 provided with a pair of pivot pins 20 defining axes A. Each wheel 1 is mounted on a respective pin 20 via roller bearings 21 held in place by a nut 22. The axes A include an angle $\alpha$ of between 100° and 150°, here 135°, with each other.

Each wheel 1 comprises a backing disk 13 formed with an inner planar region 12 and an outer frustoconical region 8. The frustoconical region 8 defines an angle $\theta$ of between 15° and 30°, here 22.5°, to a perpendicular to the respective axis A. In addition each plate 13 has a hub 14 in which the roller bearings 21 are mounted.

Each wheel 1 further is provided with an elastomeric ring 6 that is clamped in place against the surface 12 by means of a plate 15 secured to the hub 14 by hex screws 19 and having a frustoconical outer face 16 of the same degree of taper as the frustoconical face 8.

The two disks 6 are pressed together at a region 4 directly above the intersection of the axes A and a cable 3 can lie in the groove 2 formed by the outer rims 7 of these two disks 6 and the radially projecting edges 11 of the surfaces 8. The space 9 defined between the support 5 and the groove 2 is large enough to accommodate a holder clamp 10 for a support arm (load-supporting arm) capable of hanging through the gap 17 between the plates 15.

The outer rim 7 of each disk 6 is frustoconical and lies at an angle $\beta$ of between 50° and 80°, here 65°, to a perpendicular to the respective axis A. In this manner when pressed together at the top the groove 2 formed by the rims 7 is upwardly open at an obtuse angle $\Delta$ of between 120° and 160°, here 140°. In addition each ring 6 is formed on its face turned toward the respective frustoconical surface 8 with a ridge 18 that flattens out when the two rings 6 are pressed together in the region 4 so as to insure good adherence of each ring 6 to the respective wheel 1.

FIG. 2 also shows how a disk 6' may be provided which is hollow and inflatable. With such an arrangement it is possible to vary the rigidity of the system by changing the air pressure inside the hollow ring 6'.

I claim:

1. A cable guide comprising:

a support defining a pair of intersecting pivot axes inclined to the horizontal;

a pair of spaced-apart wheels each rotatable on said support about a respective one of said axes and each having an inside face turned toward the inside face of the other wheel, said inside faces approaching each other most closely at a location above the intersection of said axes and being spaced apart at said location by a predetermined distance, said wheels defining a gap adapted to clear a load-supporting arm suspended by a cable at said location; and an elastomeric disk secured to the inside face of each wheel and having an outer rim of a thickness equal to at least half said predetermined distance, said disks being resiliently compressed together at said location by said wheels and said outer rims forming at said location an upwardly open cable-receiving groove, each of said faces having a frustoconical outer region centered on the respective axis and parallel to the outer region of the other face at said location.

2. The guide defined in claim 1 wherein each of said faces has radially inside of said outer region a planar inner region perpendicular to the respective axis, said disk being generally planar in an unstressed condition, said guide further comprising means for securing said disks to said inner regions, said wheels being of greater diameter than their respective disks.

3. The guide defined in claim 2 wherein each of said disks is annular and has a side turned toward and engageable with the respective outer region, each side being normally generally planar and formed with a circumferential annular ridge compressible against the respective outer region.

4. The guide defined in claim 2 wherein each outer rim is frustoconical and centered on the respective axis and papered toward the other disk.

5. The guide defined in claim 2 wherein said means for securing includes a plate securable to each wheel at said inner region thereof over the respective disk.

6. The guide defined in claim 5 wherein each of said plates has a frustoconical face turned toward the frustoconical face of the other plate and spaced therefrom adjacent said location.

7. The guide defined in claim 1 wherein said axes lie at an angle of between 100° and 150° to each other.

8. The guide defined in claim 1 wherein each disk is a solid annular elastomeric body.

9. The guide defined in claim 1 wherein each disk is a hollow inflatable annular elastomeric body.

* * * * *